United States Patent [19]

James

[11] 4,270,234

[45] Jun. 2, 1981

[54] NET-TYPE BEDS

[75] Inventor: David R. James, Hasfield, England

[73] Assignee: James Investments Limited, Gloucester, England

[21] Appl. No.: 77,911

[22] Filed: Sep. 24, 1979

[30] Foreign Application Priority Data

Oct. 3, 1978 [GB] United Kingdom ..... 39016/78

[51] Int. Cl.[3] ..... A47B 83/04

[52] U.S. Cl. ..... 5/81 R; 5/61; 5/85; 5/90

[58] Field of Search ..... 5/61, 66, 68, 81 R, 5/83–85, 88, 90

[56] References Cited

U.S. PATENT DOCUMENTS

| | | | |
|---|---|---|---|
| 3,383,717 | 5/1968 | Underwood | 5/85 |
| 3,483,574 | 12/1969 | Belnap | 5/86 |
| 3,815,164 | 6/1974 | Smith | 5/86 |
| 3,905,055 | 9/1975 | Blair | 5/85 |
| 3,924,281 | 12/1975 | Gibbs | 5/81 R |

*Primary Examiner*—Casmir A. Nunberg

*Attorney, Agent, or Firm*—Cushman, Darby & Cushman

[57] ABSTRACT

A net-type bed comprises a flexible web slung between two parallel shafts on to which the ends of the web are wound. The shafts can be turned individually by means of handles and the bed has a self-contained support frame which is of collapsible tubular construction. The frame comprises two parallel longitudinal members spaced apart so as to lie on opposite sides of a normal bed mattress, and two cross members adapted to rest on the mattress support or base of the normal bed below the mattress. End sections of the frame are detachable from the longitudinal members and embody support crutches in which the shafts are rotatably supported.

10 Claims, 5 Drawing Figures

NET-TYPE BEDS

BACKGROUND OF THE INVENTION

1. Field of the Invention

This invention relates to beds of the type in which a patient is supported on a flexible web slung between two generally parallel shafts on to which the ends of the web are respectively wound. Thus the shafts can be turned in the same direction to transfer the web from one shaft to the other, enabling the patient to be rolled over on the web for repositioning thereon, and they can also be turned in opposite directions so as to raise or lower the patient with respect to a conventional mattress or other support surface below the web.

2. Description of the Prior Art

When the web is of mesh or net form, as disclosed for example in U.K. patent specification No. 1,447,163 and U.S. Pat. No. 3,905,055, such beds are particularly valuable in the prevention and treatment of bed sores. Beds of the type concerned are hereinafter and in the appended claims referred to as "net-type beds", this term where appropriate to be construed broadly to include a flexible web of any form, i.e. not necessarily of mesh or net form although this is normally preferred.

Net-type beds are in general use as attachments for an existing hospital bed, having four spaced support crutches for the rotatable shafts and which have to be adapted to the construction of the actual model of bed being employed using spacers and special adaptors. These must provide the necessary rigidity and the desired shaft spacing, with the correct longitudinal spacing determined by bearing components of the shafts. Thus a range of adaptors has to be provided to suit the wide diversity of different hospital bed designs in general use. This, and the mechanical work involved, usually means that a net-type bed cannot be attached by the nursing personnel, but requires the attention of a hospital engineer, and the result is that net beds although available tend to be underemployed even when their use is medically indicated and would benefit a patient.

It has been proposed that a net bed should employ a completely self-contained and independent support structure, for example in the aforesaid U.K. patent specification No. 1,447,163 and in U.S. Pat. No. 3,302,219. Such structures are expensive and unacceptably cumbersome, particularly if designed to fit around and over an existing hospital bed, and hence they have not enjoyed much commercial success.

SUMMARY OF THE INVENTION

The object of the invention is to provide a net-type bed for use with an existing conventional bed which has the advantages of previously proposed attachable and independent net-type bed structures while obviating the main disadvantages of both. A further object is to provide a simple and low-cost solution to the problem of mounting a net-type bed upon a normal bed. In particular it provides a net-type bed which can be brought into use by nursing personnel immediately it is medically indicated and without technical assistance, and which can be designed so as to be usable with any existing bed including domestic type beds when this is required.

According to the invention a net-type bed for mounting on a normal bed has a self-contained support frame which includes support crutches at each end for the rotatable shafts of the net-type bed, and comprises two spaced longitudinal members adapted to extend along either side of the normal bed mattress to rigidly interconnect and determine the longitudinal spacing of the end support crutches, and support means which extend inwardly of the longitudinal members and are adapted to rest on the mattress support or base of the normal bed below the mattress thereof.

Preferably the support means comprise two cross members which extend over the width of the frame between the longitudinal members, and the longitudinal members are preferably underslung with respect to the cross members for location relative to the sides of the mattress base. The frame to facilitate storage and transport is conveniently collapsible with end frame sections which include the support crutches and which are detachable from the longitudinal members. One cross member of the support means may be embodied in the head end frame section with the other cross member mounted on the longitudinal members themselves, in which case this other cross member is preferably detachable from the longitudinal members. The end frame sections may themselves be collapsible.

The support frame of the invention may be adapted for attachment of support means, for example by the provision of attachment brackets for support legs, to enable the bed to be used in a free-standing form with the frame raised off the floor. This provides a dual-purpose bed which, when desired, can be used independently of the normal bed.

Other features of the invention will be apparent from the following description, drawings and claims, the scope of the invention not being limited to the drawings themselves as the drawings are only for the purpose of illustrating a way in which the principles of the invention can be applied. Other embodiments of the invention utilising the same or equivalent principles may be used and structural changes may be made as desired by those skilled in the art without departing from the present invention and the purview of the appended claims.

DESCRIPTION OF THE PREFERRED EMBODIMENTS

Figure 1:
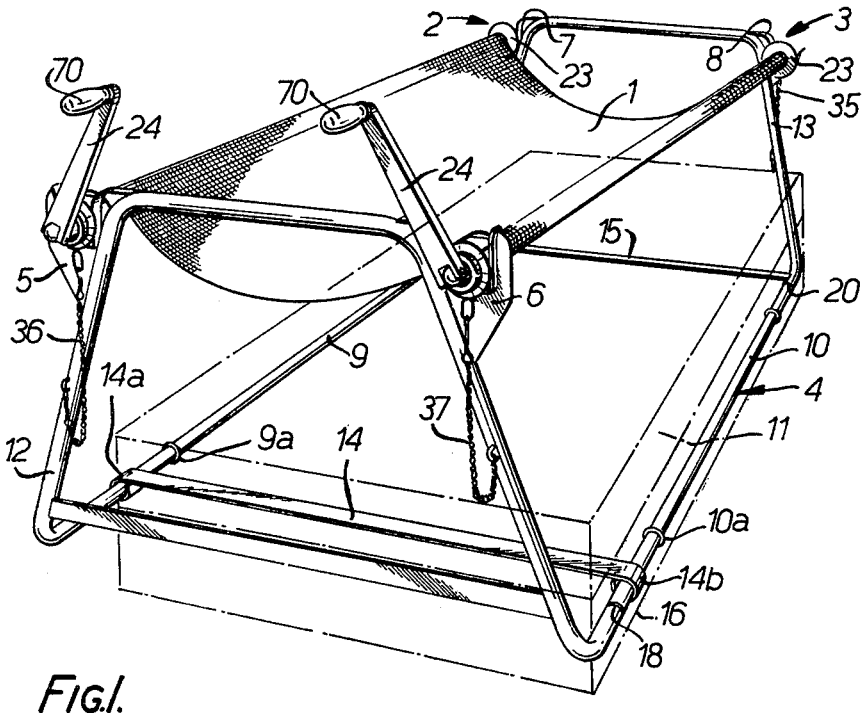
FIG. 1 is an end perspective view of a net bed with a collapsible support frame in accordance with the invention.
Figure 2:
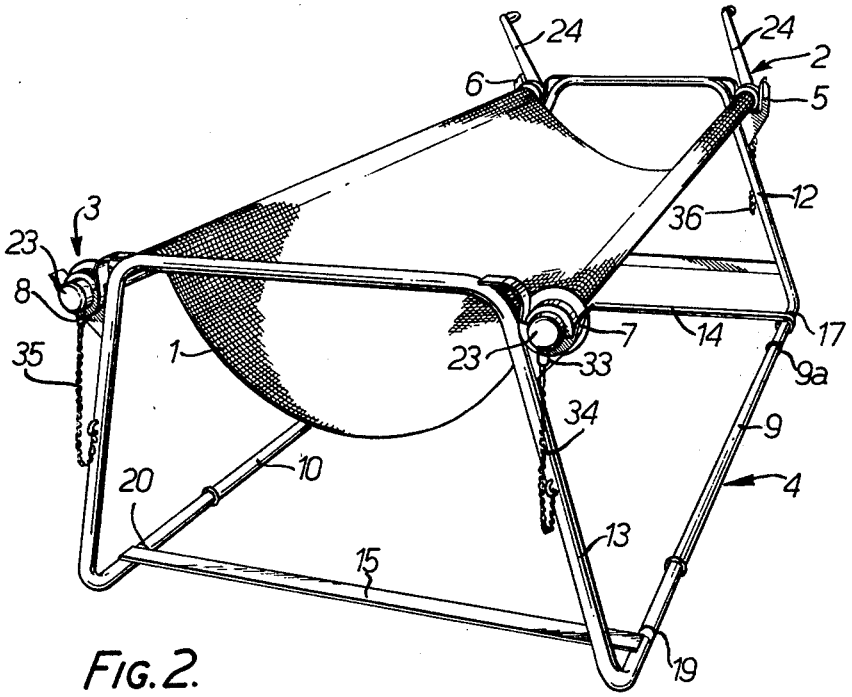
FIG. 2 is an opposite end perspective view of the same bed.

The net bed of FIGS. 1 to 4 comprises a flexible web 1, in this case as shown the web being of mesh or net form, slung between two parallel winding shaft assemblies 2 and 3 on to which the ends of the web 1 are respectively wound as clearly shown in FIGS. 1 and 2. A collapsible support frame mainly of tubular construction and which is in accordance with the invention provides two spaced support crutches 5 and 6 at one end of the frame, and similarly spaced support crutches 7 and 8 at the other end of the frame, in which the adjacent ends of the shaft assemblies 2 and 3 are respectively supported. The frame 4 comprises two spaced parallel longitudinal members 9 and 10 which, in use with a normal bed and in the erected condition illustrated, extend along either side of the normal bed mattress which for purposes of illustration is shown in broken lines at 11 in FIG. 1. The longitudinal members 9 and 10 rigidly interconnect and determine the longitudinal spacing of end frame sections 12 and 13, the frame section 12 including the support crutches 5 and 6 and the frame section 13 including the support crutches 7 and 8.

The collapsible frame 4 includes support means in the form of a cross member 14 which extends inwardly of and between the longitudinal members 9 and 10 adjacent the foot-end frame section 12, and a cross member 15 which also extends inwardly of the longitudinal members 9 and 10 but in this case is an integral part of the head-end frame section 13. The cross member 14 has end portions 14*a* and 14*b* in the form of closed loops respectively slidable on the longitudinal members 9 and 10 to allow a degree of longitudinal adjustment of the cross member 14. Annular projections 9*a* and 10*a* on the members 9 and 10 provide limiting abutments which prevent adjustment of the cross member 14 beyond the projections to a position where unstable support of the frame might result. In use the cross members 14 and 15 rest on the mattress support or base of the normal bed, shown in broken lines at 16, below the bed mattress. The end sections 12 and 13 have simple spigot and socket connections at 17 and 18, 19 and 20 respectively with the longitudinal members 9 and 10 so that the frame 4 can readily be collapsed and dismantled for transport and storage.

Figure 3:
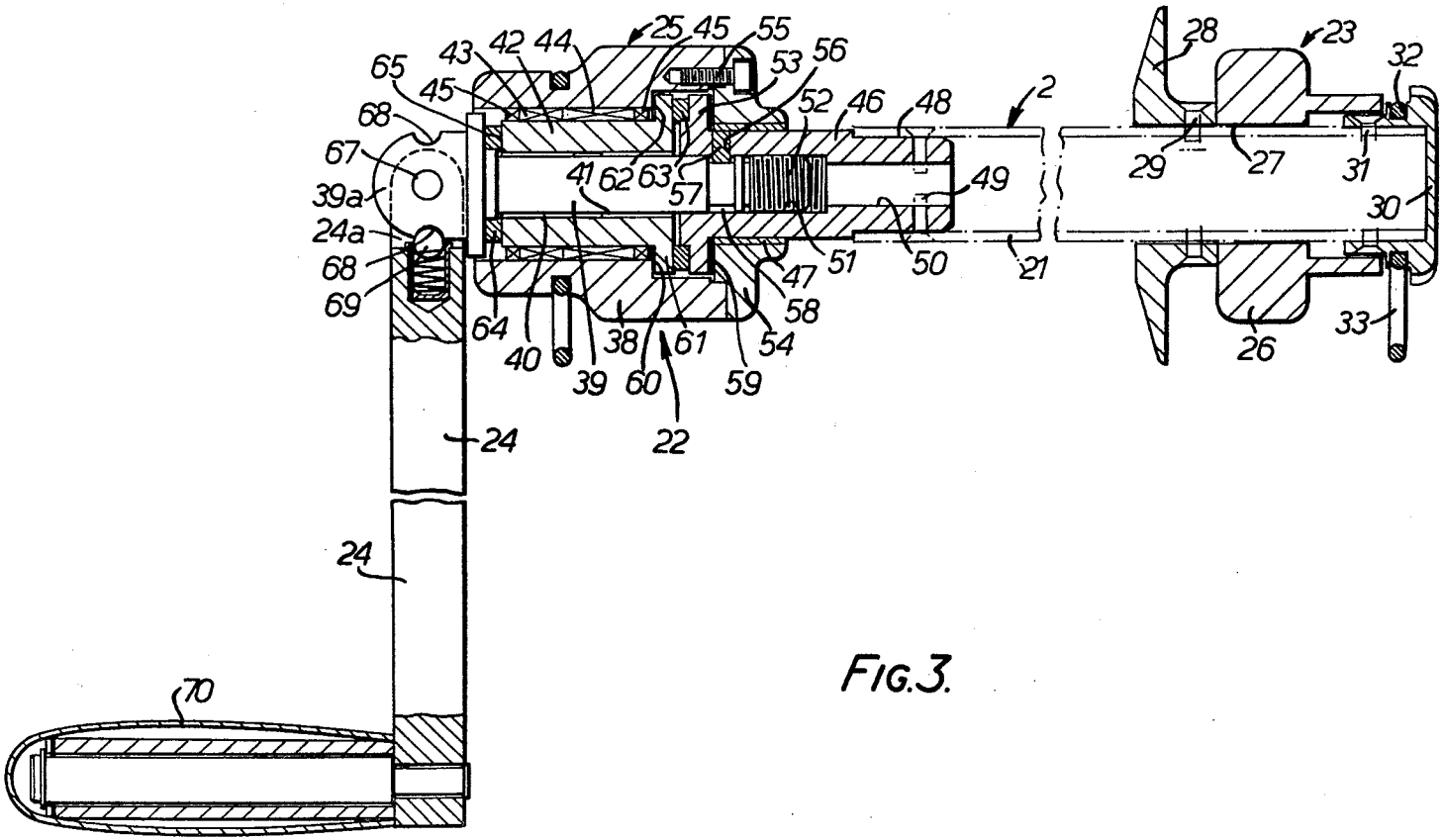
FIG. 3 is an axial sectional view of a winding shaft assembly of the bed of FIGS. 1 and 2.
Figure 4:
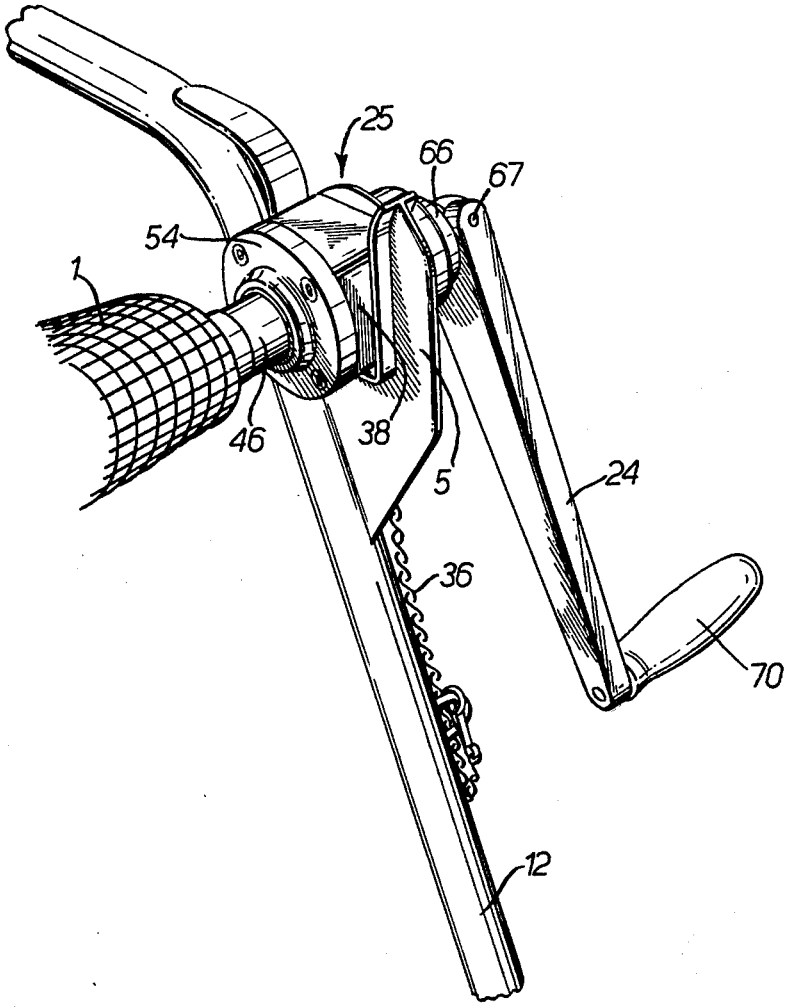
FIG. 4 is a detail perspective view.

The shaft assemblies 2 and 3, as illustrated in FIG. 3 with reference to the shaft assembly 2, comprise a tubular shaft member 21 around which the corresponding end of the web 1 is wound and which extends between end fittings 22 and 23. The end fitting 22 includes a winding handle 24 by which the shaft is turned through a drive clutch/brake unit 25. The end fitting 23 comprises a stepped annular bearing member 26 which rests in the support crutch 7 and has an inner bore 27 providing a plain bearing allowing free rotation of the shaft when turned by the handle 24.

Also included in the end fitting 23 is an inner annular locating member 28 riveted to the tubular member 21 at 29 and a stepped locating member 30 riveted to the tubular member 21 at 31. The bearing member 26 is axially located on the tubular member 21 between the members 28 and 30 and the member 30 forms an end closure cap for the member 21. The member 30 also has an external annular groove 32 engaging a free-running captive ring 33 which can be detachably clipped to a chain 34 (see FIG. 2) by which the shaft is held captive. This chain, and corresponding chains 35, 36 and 37, enable the shaft assemblies 2 and 3 to be lifted out of the support crutches and to hang freely at the side of the bed on the chains, with the web 1 draped across the bed mattress 11 on which the patient is then for the time being supported.

The drive clutch/brake unit 25, referring particularly to FIG. 3, has a housing 38 of square external profile by which it locates in the angular sense (see FIG. 4) in the support crutch 5 whereby it is restrained against rotation. The handle 24 is mounted on the outer end of a drive shaft 39 which is mounted in bearing bushes 40 and 41 in a coaxial annular clutch bush 42. The bush 42 is rotatably mounted in a bearing 43 in the housing 38, and in the annular space between the bush 42 and the housing 38 a one-way roller-type clutch 44 is mounted alongside the bearing 43, this space being closed at the ends by seals 45. In the shaft assembly 2 the clutch 44 prevents rotation of the bush 42 in the clockwise direction when viewed from the handle end, and allows rotation in the counter-clockwise direction. The clutches of the two shaft assemblies 2 and 3 are "handed" in respect of the operative direction of rotation.

A drive bush 46 which projects from the inner side of the housing 38 is rotatably mounted in a bearing bush 47 coaxially with the shaft 39 and bush 42. At the outer end the bush 46 is stepped at 48 for fitting of the tubular member 21, riveted at 49, and a through bore 50 has an inner end counterbore 51 screwthreaded for engagement by a complementary coarse-pitch screw thread on an inner end portion 52 of the handle shaft 39. The bush 46 has an inner end flange 53 by which it is retained captive in the housing 38 by means of an annular end cap 54 attached to the housing by screws 55. The bush 46 has a through slot 56 around part of its periphery to receive a segment 57 which projects inwardly of the bore of the bush 46 for engagement with axial clearance in a peripheral groove 58 in the shaft 39. A thrust washer 59 is positioned between the flange 53 and the end cap 54, and axial location in the lefthand direction in FIG. 3 is provided by an internal step 60 within the housing 38 which is engaged by an inner end flange 61 on the clutch bush 42 through the intermediary of a thrust washer 62. An annular friction disc 63 is positioned between the flanges 53 and 61, and an annular clutch disc 64 is positioned between the outer end face 65 on the bush 42 and an end flange on the shaft 39.

The clutch/brake unit 25 of the shaft assembly 2 operates as follows. When a patient is supported on the web 1 the weight of the patient tends to turn the shaft in the clockwise direction viewed from the handle end, and this results in a torque being applied to the drive bush 46 in a direction which screws it on to the drive shaft 39 so that this bush and shaft are frictionally locked to the bush 42 by the friction discs 63 and 64. Thus the torque is transmitted to the clutch bush 42 and the clutch 44 operates to prevent rotation so that the patient remains reliably suspended at the adjusted height. However, if it is desired to unwind the net the handle 24 can be turned in the counter-clockwise direction which unscrews the shaft 39 from the bush 46 sufficiently to free the friction discs 63 and 64, and this allows the friction clutch/brake to slip until the angular movement of the drive bush 46 catches up with the handle movement when the friction braking is again operative. Thus the friction clutch slips to provide a follow-up action between the shaft and the handle in the unwinding direction. If it is required to wind on the net turning of the handle 24 tends to screw the drive shaft 39 into the drive bush 46 thus clamping up the friction discs 63 and 64 more firmly, but the one-way clutch 44 now allows free rotation of the clutch bush 42, with the shaft 39 and bush 46, within the housing 38.

The drive clutch/brake unit of the other shaft assembly 3 operates in the same manner, the only difference being that the two units are "handed" in respect of the operative direction of the clutch 44 and the screw thread between the shaft 39 and bush 46.

The handle 24 has a forked end 24*a* attached to a flat end portion 39*a* of the shaft 39 by a pivot pin 67 disposed diametrically of the drive axis. The end portion 39*a* has an arcuate profile with two opposed detent notches 68 alternatively engageable by a spring-loaded detent ball 69 mounted in the handle 24. Thus the handle can occupy either the operative position illustrated, in which a pivotal hand grip 70 at the outer end allows the handle to be turned, or a "parked" position turned 180° about the pivot pin 67 in which the hand grip 70 is inwardly facing and does not project at the end of the bed.

Figure 5:
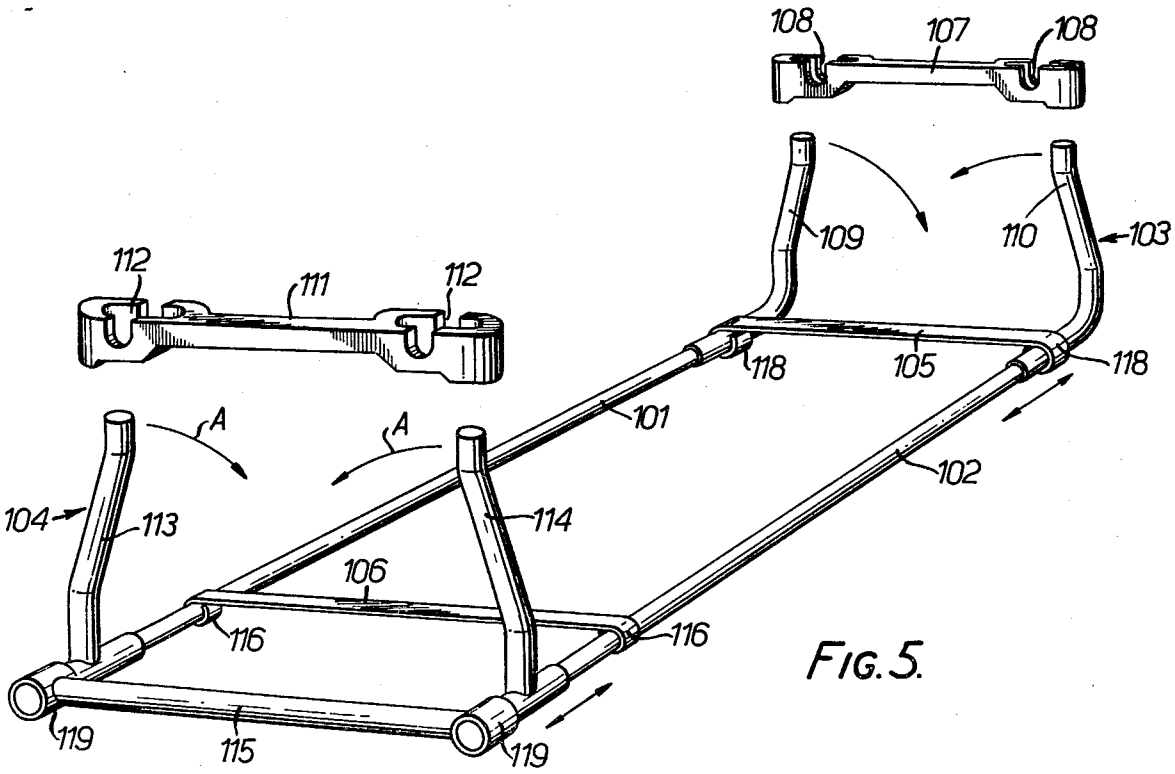
FIG. 5 is a perspective view of another collapsible support frame of a net bed in accordance with the invention.

A different design of collapsible support frame also in accordance with the invention is illustrated in FIG. 5. In this case the frame is shown erected and in partly exploded view with the shaft assemblies and flexible web removed. The frame is again mainly of tubular construction and comprises two spaced and parallel longitudinal members 101 and 102 which extend between and determine the longitudinal spacing of a head-end frame section 103 and a foot-end frame section 104. The spacing of the members 101 and 102 is such that as with the first embodiment described they will extend on either side of a bed mattress with the frame supported on the mattress support of a normal bed by a cross member 105, which is part of the frame section 103, and a cross member 106 mounted on the members 101 and 102 adjacent the frame section 104.

In addition to the cross member 105 the frame section 103 comprises a horizontal head crutch member 107 providing spaced crutch supports at 108 for the shaft assemblies of the net bed, in the usual manner. This member 107 is supported on two uprights 109 and 110 within which the head ends of the members 101 and 102 telescopically engage and between which the cross member 105 is mounted. The foot-end frame section 104 similarly comprises a top crutch member 111 providing crutch supports 112 and mounted on uprights 113 and 114 within which the foot ends of the members 101 and 102 telescopically engage and which, at their lower ends, are interconnected by a cross member 115. It will be appreciated that in use the frame section 104 will be beyond the foot of the bed and hence the cross member 115 cannot be used to support the foot end of the frame, the adjacent cross member 106 of the support means accordingly being necessary.

The aforementioned telescopic engagement of the ends of the longitudinal members 101 and 102 enables the frame sections 103 and 104 to be detached therefrom, and the cross member 106 is as before mounted by end loop portions 116 so that it can be slid off the members 101 and 102. Stop pins on the members 101 and 102 limit the insertion thereof into the loop portions 116 on assembly, corresponding to the abutment projections 9*a* and 10*a* of the first embodiment, so that the cross member 106 must be positioned adjacent the foot end as is necessary for stable support of the frame.

Each end frame section 103 or 104 is also collapsible. The top crutch members 107 and 111 are telescopically engaged by the uprights 109,110 and 113,114 respectively, so that they can readily be detached as shown in FIG. 5. This enables the uprights to be swung downwardly and inwardly as shown by arrows A, so that the uprights 109 and 110 fold flat with the cross member 105 and the uprights 113 and 114 fold flat with the cross member 115. To this end the cross members 105 and 115 have tubular end mounting sections 118 and 119 respectively, within which the respective uprights are axially located while free to turn. The end sections 118 and 119 are arranged such that the members 101 and 102 are as before underslung with respect to the members 105 and 106, and hence lateral location of the frame is provided by the side edges of the bed mattress base on which the cross members 105 and 106 rest.

It will be clear from the foregoing description of two specific preferred embodiments that the invention eliminates the need for support crutches adapted specifically to each individual model of bed and in place thereof provides for a self-contained crutch frame which, resting upon the mattress base and locating relative to the sides thereof, is immediately adaptable to a wide range of beds having a comparable width of mattress. The frames described can rapidly be erected without the use of tools from a set of parts which are convenient to handle, transport and package. A manufacturing advantage is that the design of parts is such that they can readily be stoved, if an enamel finish is desired, or resin coated for example with P.V.C. or nylon.

A frame in accordance with the invention has the further advantage that it is usable with any existing bed including a three-quarter or double-size domestic bed which does not have a bed frame to which normal net bed support crutches can be attached. In this case the present frame can be used with the longitudinal members (9,10 or 101,102) merely resting on top of the domestic bed.

Either of the illustrated frames can readily be adapted for alternative free-standing use, raised off the floor, by the provision of supporting brackets for the attachment of support legs or the like. Various ways in which this can be done will immediately occur to those skilled in the art, and hence they are not shown in the drawings or specifically described herein.

As the shaft assemblies are "handed" it is essential that they be positioned at the correct side of the frame. As a safety precaution it is desirable that the assemblies should not be capable of fitting at the wrong side. For example, the clutch/brake housings 38 may be of differing size and/or shape in the two assemblies 2 and 3, and the crutches 7 and 8 correspondingly formed to prevent incorrect fitting on the wrong side of the frame 4.

I claim:

1. A net-type bed adapted for mounting on a normal bed having a mattress base and a mattress, said net-type bed comprising: two rotatable shafts to support a flexible web between them, and a self-contained support frame which includes support crutches at each end of the frame for supporting said rotatable shafts, two spaced longitudinal frame members adapted to extend along either side of said normal bed mattress to rigidly interconnect and determine the longitudinal spacing of said end support crutches, and support means for said frame extending inwardly of said longitudinal members and adapted to rest on said mattress base of the normal bed below said mattress thereof.

2. A net-type bed according to claim 1, wherein said support means comprise two cross members which extend over the width of the frame between said longitudinal members.

3. A net-type bed according to claim 2, wherein said longitudinal members are underslung with respect to the cross members whereby to provide lateral location of the frame relative to the sides of said mattress base.

4. A net-type bed according to claim 1, wherein said support frame is collapsible and comprises end frame sections which are detachable from said longitudinal members.

5. A net-type bed according to claim 4, wherein said support means comprise two cross members which extend over the width of the frame between the longitudinal members and one of which is embodied in one of the end frame sections while the other of the cross members extends directly between and detachable from said longitudinal members.

6. A net-type bed according to claim 4, wherein the support frame is mainly of tubular construction and each of said end sections has spigot and socket connections with the tubular longitudinal members and comprises an upstanding loop to the sides of which the support crutches are attached adjacent the top of the loop.

7. A net-type bed according to claim 4, wherein said end frame sections are themselves collapsible.

8. A net-type bed according to claim 7, wherein each of said end frame sections comprises two spaced upright members pivotal on end section members having spigot and socket connections with the longitudinal frame members, and a crutch member which extends between and fits over the top ends of the upright members to maintain the latter in the erected condition.

9. A net-type bed according to claim 1, wherein the support frame is adapted for attachment of support means, such as support legs, to enable the bed to be used in a free-standing form raised from the floor.

10. A net-type bed according to claim 1, wherein rotatable shaft assemblies detachably mountable in said support crutches each comprise a shaft, a winding handle, and a clutch/brake unit through which said shaft is coupled to said handle and which engages the corresponding support crutch in a non-rotatable manner, said clutch/brake unit comprising a one-way clutch and a friction clutch assembly arranged in series in the drive sense with the one-way clutch operative to prevent shaft rotation in the web-unwinding direction.

* * * * *